US007563075B2

(12) United States Patent
Wenckebach et al.

(10) Patent No.: US 7,563,075 B2
(45) Date of Patent: Jul. 21, 2009

(54) LIQUID RING PUMP

(75) Inventors: Bernd Wenckebach, Itzehoe (DE); Silke Heetsch, Itzehoe (DE); Alfons Jünemann, Itzehoe (DE)

(73) Assignee: Sterling Fluid Systems (Germany) GmbH, Itzehoe (DE)

( * ) Notice: Subject to any disclaimer, the term of this patent is extended or adjusted under 35 U.S.C. 154(b) by 323 days.

(21) Appl. No.: 10/557,304

(22) PCT Filed: May 4, 2004

(86) PCT No.: PCT/EP2004/004743

§ 371 (c)(1),
(2), (4) Date: Aug. 28, 2006

(87) PCT Pub. No.: WO2004/102003

PCT Pub. Date: Nov. 25, 2004

(65) Prior Publication Data

US 2007/0065298 A1 Mar. 22, 2007

(30) Foreign Application Priority Data

May 16, 2003 (EP) ..... 03011218

(51) Int. Cl.
*F04C 19/00* (2006.01)

(52) U.S. Cl. ..... 417/68; 417/244

(58) Field of Classification Search ..... 417/68, 417/244; 418/11, 12, 13
See application file for complete search history.

(56) References Cited

U.S. PATENT DOCUMENTS

| | | | | | |
|---|---|---|---|---|---|
| 1,699,327 | A | | 1/1929 | Durdin, Jr. | |
| 2,416,538 | A | | 2/1947 | Nelson | |
| 3,228,587 | A | * | 1/1966 | Segebrecht | 417/62 |
| 4,443,158 | A | * | 4/1984 | Bentele et al. | 417/68 |
| 4,747,752 | A | * | 5/1988 | Somarakis | 417/68 |
| 4,992,028 | A | * | 2/1991 | Schoenwald et al. | 417/68 |

FOREIGN PATENT DOCUMENTS

| | | |
|---|---|---|
| DE | 27 14 475 | 10/1977 |

* cited by examiner

*Primary Examiner*—Michael Cuff
*Assistant Examiner*—Vikansha S Dwivedi
(74) *Attorney, Agent, or Firm*—Alix, Yale & Ristas, LLP

(57) ABSTRACT

A liquid ring pump comprises a first housing part that radially encloses two or more working chambers in which a rotatably mounted impeller is disposed in an eccentric manner, second and third housing parts that seal both sides of the first housing part and the pump, ducts or chambers for delivering and discharging the conveyed gas, and control disks that delimit the working chambers in an axial direction. The first housing part is embodied as a single piece while a connecting duct is provided which extends from the second to the third housing parts, and the ports facing the respective adjacent housing parts are configured such that the second and third housing parts can be embodied in an identical manner.

15 Claims, 2 Drawing Sheets

LIQUID RING PUMP

BACKGROUND OF THE INVENTION

The invention relates to a liquid ring pump having a first housing part which encloses two or more working spaces radially, in which in each case there is arranged an eccentrically rotatably mounted impeller, having second and third housing parts, which seal off the first housing part and the pump on both sides and have ducts or chambers for the supply and discharge of the gas conveyed, and having control disks that bound the working spaces in the axial direction.

In liquid ring pumps, an impeller rotates within an eccentrically circulating liquid ring. During the rotation, the liquid ring penetrates to a greater or lesser extent into the cells formed between the vanes of the impeller. As a result, the free volume in the impeller cells is alternately enlarged and reduced. In that region of the revolution in which the cell volume is enlarged, the suction opening, through which the gas to be conveyed is sucked into the cells, is located at the end in a control disk. In the end region of that part of the revolution in which the compression is carried out, there is the pressure opening, through which the compressed gas in the pressure space of the pump is exhausted.

Liquid ring pumps are employed both as a vacuum pump, where they compress the gas conveyed from a negative pressure to approximately atmospheric pressure, and also as compressors, in which they compress the gas conveyed from atmospheric pressure to a positive pressure. There are liquid ring pumps of single-stage and multistage designs. Single-stage liquid ring pumps can be applied as a vacuum pump in the upper coarse vacuum or as a compressor, on account of the low compression ratio. Multi-stage machines have their preferred range of use as a vacuum pump in the lower pressure range of the vacuum.

The working spaces in which the impeller rotates and in which the liquid ring is built up are bounded axially on one side or on both sides by a control disk. In the case of multistage liquid ring pumps, these working spaces with impeller and control disks are arranged one after another axially in an appropriate number.

Traditionally, a liquid ring pump (cf., for example, DE 27 14 475) comprises a large number of components which are arranged on one another in the axial direction during the pump assembly. The supporting surfaces of the individual components are at the same time sealing surfaces of the machine from the pump interior to the environment. Axially on the outside, the control disks are adjoined by the outer housing, in which ducts or chambers for the guidance of the gas and liquid streams are contained. Surfaces which in turn have to be sealed off are also present between the control disks and the outer housings.

Such a conventional liquid ring pump has, in a two-stage design, seven axial sealing surfaces (DE 27 14 475). Accordingly, the assembly is complicated and the design is expensive and also has the disadvantage of a large number of surfaces which have to be sealed off, in particular a greater risk of developing leaks earlier in operation.

In the case of two-stage liquid ring compressors, a widespread design is provided with a diagonal connecting tube, with which part of the gas to be compressed and of the operating liquid are led on the outside from the pressure opening of the first stage to the suction opening of the second stage (DE-B 870 004). Since this connecting tube is fitted to housing connectors on both sides, there are two further sealing surfaces here. The disadvantages of these classical designs are the large number of individual parts with correspondingly high fabrication costs for the machining of the many surfaces and the many surfaces which have to be sealed off between the pump components.

Many approaches to simplifying pump parts or to fusing a number of pump parts and in this way reducing the number of parts of the liquid ring pumps are already known. For example, it is known to design a control disk with the central element as one component (drawing from Travaini Pumpen TRHC 40-60). A single-stage liquid ring compressor is also known in which the division of the gas streams on the suction side and leading the gas streams together on the pressure side are not carried out outside the compressor by means of what are known as Y tubes; instead, the gas stream is connected only in one side of the housing and the division to the respective other side of the housing is carried out by means of straight tubes (EP 0 584 106 B1). Is also known to accommodate all the actual flow ducts in the central housing part (DE 197 58 340 A1) The disadvantage of this embodiment is that it can be applied only to single-stage liquid ring pumps.

The object of the invention is to provide a liquid ring pump of the type mentioned at the beginning in which the number of individual parts and, in particular, the number of sealing surfaces to the outside is reduced considerably.

SUMMARY OF THE DISCLOSURE

A solution comprises the first housing part being formed in one piece, at least one connecting duct leading from the second to the third housing part, and the first housing part having an axis at right angles to the axial direction in such a way that, by rotating the first housing part through 180° about the axis, the contact surfaces and fixing elements sealing with the second and third housing part are transferred identically into one another. By means of this configuration, the adjacent second and third housing parts can be formed identically. The number of different individual parts of the pump is reduced.

The invention can be applied to two-stage and multistage liquid ring pumps. The first housing part advantageously has an intermediate wall for accommodating internal control disks between the two working spaces, with in particular at least one duct for leading the conveyed gas through.

In one advantageous embodiment, the first housing part has no more than two surfaces which are connected to the working spaces and with which it adjoins other housing parts or other fitted parts.

The construction of the pump is simplified further if the first housing part has connections for emptying and/or and emptying dirt, for cavitation prevention and for venting on the suction side.

In one advantageous embodiment, the housing parts can be formed as a cast construction. In another advantageous embodiment, the housing parts are formed as a welded construction.

Particularly simple assembly is possible if the first housing part has fixing elements to be clamped axially with the second and third housing parts.

The liquid ring pump according to the invention contains the following previous components or functions in a single component, specifically the first housing part according to the invention:

- the classical tube-like central element in duplicate,
- the connecting tube which leads the flow from the first to the second stage,
- the holder of the central control disks, now to be configured particularly simply as flat disks, the outer control disks can be clamped between the first housing and the second or third housing in such a way that no double external sealing is required, the total number of sealing surfaces is reduced from nine to now just two sealing surfaces. In the conventional two-stage pump, there were seven sealing surfaces between the control disks, central elements and external housings and also two between the housings and the connecting tube.

The design according to the invention is distinguished by a low number of components and few sealing surfaces to the outside. As a result, considerable advantages arise during the fabrication and assembly process and in the operational reliability of the novel liquid ring pump. A particular advantage is also that the second and third housing parts can be formed identically, which likewise reduces the production costs and the stock holding costs for replacement parts.

BRIEF DESCRIPTION OF THE DRAWINGS

The invention will be described by way of example in the following text using advantageous embodiments and with reference to the appended drawings, in which.

DETAILED DESCRIPTION OF THE PREFERRED EMBODIMENTS

Figure 1:
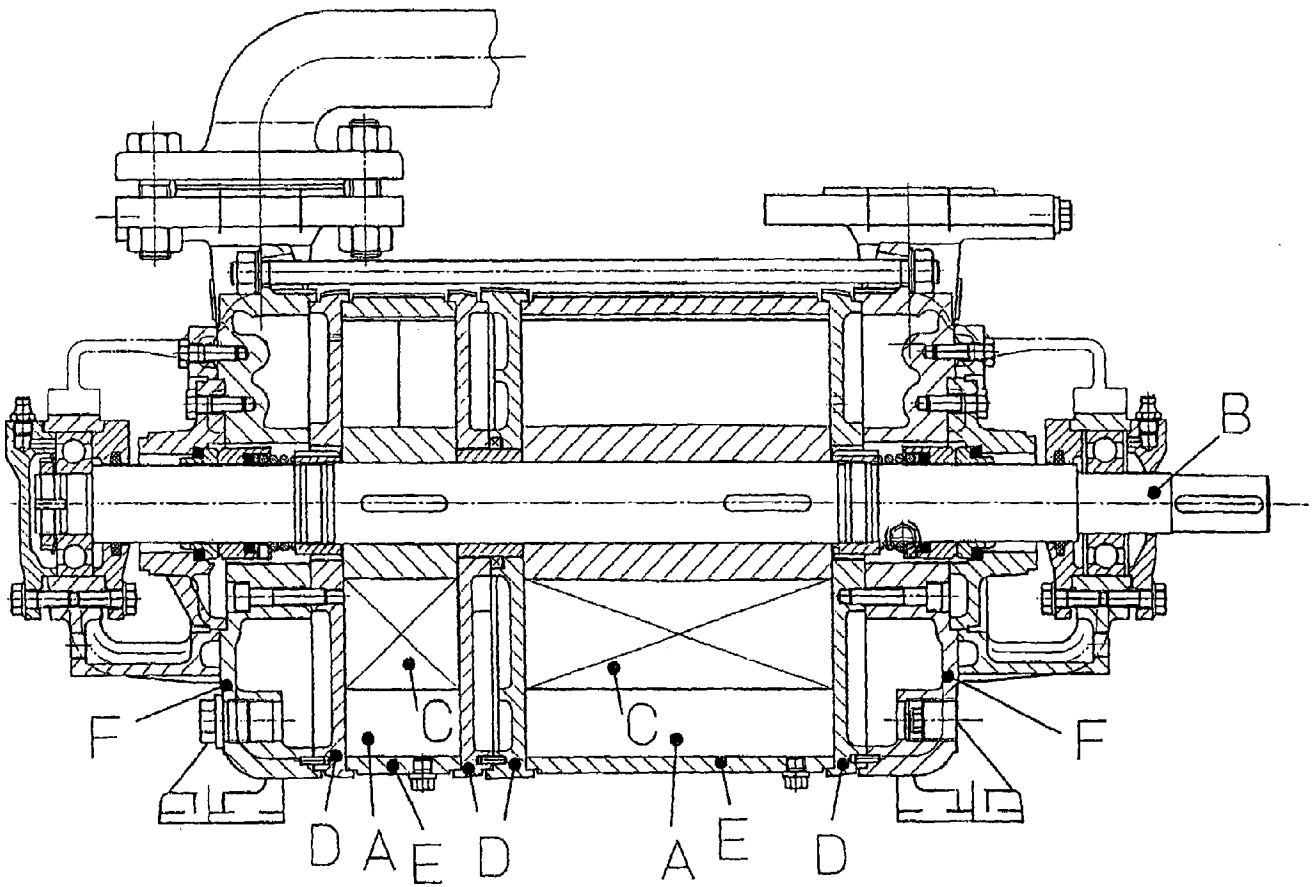
Figure 1 PRIOR ART
FIG. 1 shows a conventional liquid ring pump in cross section.

In FIG. 1, a conventional liquid ring pump is shown in cross section. In working spaces A, impellers C are mounted eccentrically on a shaft B. The working spaces A in this case are partly filled with a liquid, in particular water, so that the cells between the vanes of the impellers are enlarged and reduced on account of the liquid ring, which achieves the pumping action. At the ends of the impellers C there are control disks D and therefore, in the embodiment of FIG. 1, four such control disks. Housing parts E bound the working spaces to the outside in the radial direction. At the two ends there are also housing parts F, which have the necessary ducts or chambers for the supply and discharge of the gas to be pumped. As can clearly be seen in FIG. 1, very many components are assembled one after another in the axial direction, in each case a seal to the outside having to be provided at the connecting points.

Figure 2:
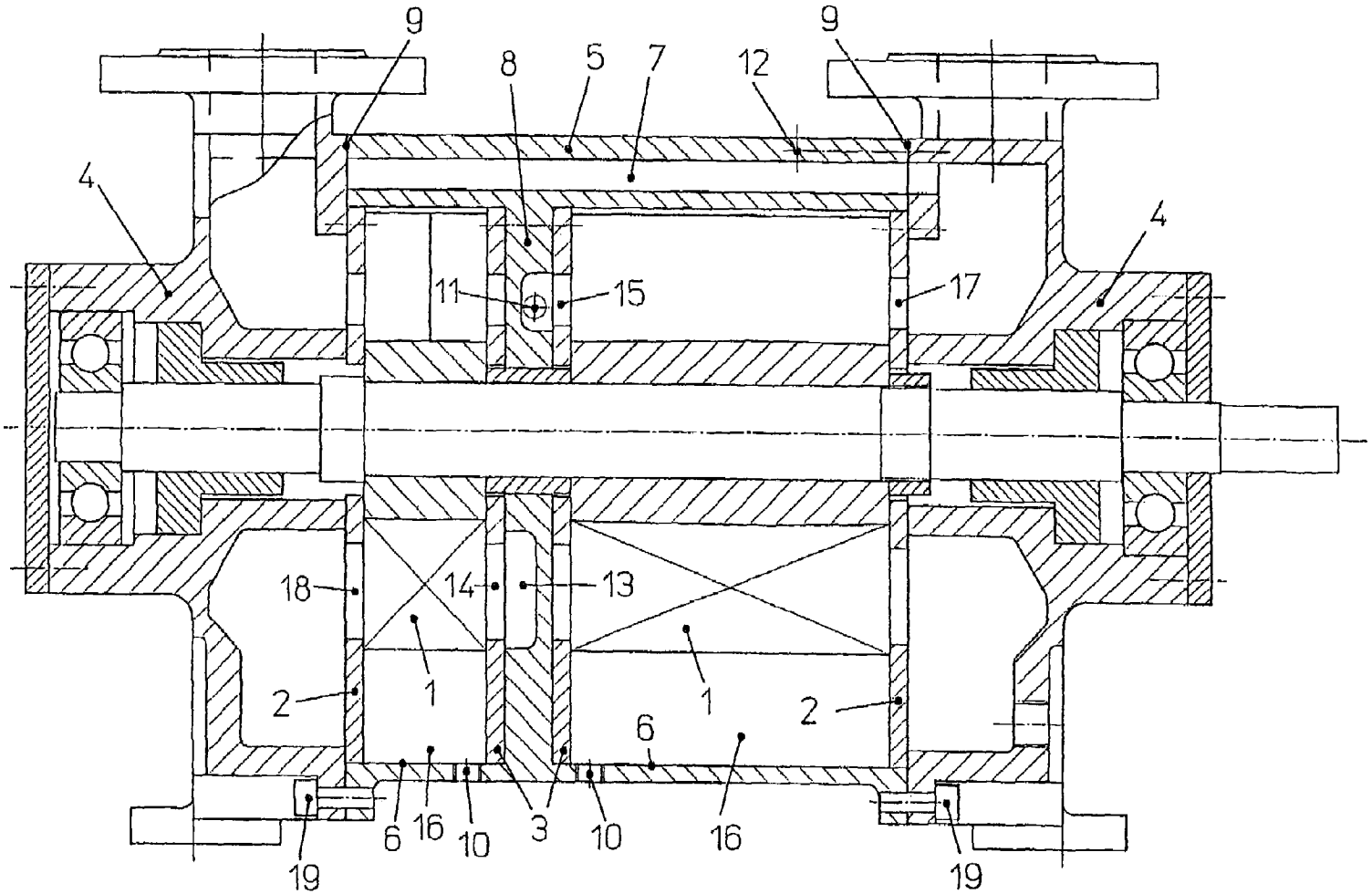
FIG. 2 shows an embodiment of a liquid ring pump according to the invention in cross section.

The pump according to the invention, as shown in FIG. 2, likewise has two impellers 1, which are fitted to a shaft 11 and rotate in the eccentric working spaces 16. At the outer ends of the impellers 1 there are control disks 2; in the center between the impellers 1 there are control disks 3, the control disks being provided with suitable openings through which the gas to be pumped enters into and exits from the working spaces 16. Shown in FIG. 2 is a connecting duct 13 which connects the suction opening 14 of the left (second) stage to the pressure opening 15 of the right (first) stage, with which a partial stream of the gas conveyed is led from the right (first) stage into the left (second) stage. The respective other opening of the central control disks 3 is covered by the central wall 8 and therefore has no function. This central wall 8 is part of a first housing part 5, which surrounds the working spaces 16. This first housing part 5 has a further connecting duct 7 for the gas streams within the pump. Via this connecting duct 7, a second partial stream of the gas conveyed is led from the pressure opening 17 of the right (first) stage to the suction opening 18 of the left (second) stage.

At 10 openings are shown through which the working fluid and/or dirt can be emptied. These openings are closed during the normal operation of the pump. At 11 means for cavitation prevention are indicated. At 12 means for venting the pump on the suction side are indicated.

As can be seen, the outer wall 6, which bounds the working space 16, the intermediate wall 8 and the connecting duct 7 are formed in one piece. Further components are the second and third housing parts 4 arranged on the left and right of the first housing part 1, which can be formed identically. The only sealing surfaces to the outside are the sealing surfaces between the first housing and the second housing 4. These sealing surfaces are designated 9. 19 designates screws with which the housing parts 1, 4 are fixed to each another.

The invention claimed is:

1. A liquid ring pump having a first housing part which encloses two or more working spaces radially, in which in each case there is arranged an eccentrically rotatably mounted impeller, having second and third housing parts, which seal off the first housing part and the pump on both sides and have ducts or chambers for the supply and discharge of the gas conveyed, and having inner and outer control disks that bound the working spaces in the axial direction, characterized in that the first housing part is formed in one piece, and has an intermediate wall between the two working spaces which accommodates the inner control disks, at least one connecting duct leading from the second to the third housing part is provided, and in that the first housing part has an axis at right angles to the axial direction in such a way that, by rotating the first housing part through 180° about this axis, the contact surfaces and fixing elements sealing with the second and third housing part are transferred identically into one another.

2. The liquid ring pump as claimed in claim 1, characterized in that the intermediate wall has at least one duct to lead the conveyed gas through.

3. The liquid ring pump according to claim 1, characterized in that the first housing part has no more than two surfaces which are connected to the working spaces and with which it adjoins other housing parts or other fitted parts.

4. The liquid ring pump as claimed in claim 1, characterized in that the first housing part has connections for emptying fluid and/or emptying dirt, for cavitation prevention and for venting on the suction side.

5. The liquid ring pump as claimed in claim 1, characterized in that the housing parts are formed as a cast construction.

6. The liquid ring pump as claimed in claim 1, characterized in that the housing parts are formed as a welded construction.

7. The liquid ring pump as claimed in claim 1, characterized in that the first housing part has fixing elements to be clamped axially with the second and third housing parts.

8. The liquid ring pump according to claim 2, characterized in that the first housing part has no more than two surfaces which are connected to the working spaces and with which it adjoins other housing parts or other fitted parts.

9. The liquid ring pump as claimed in claim 2, characterized in that the first housing part has connections for emptying fluid and/or emptying dirt, for cavitation prevention and for venting on the suction side.

10. The liquid ring pump as claimed in claim 2, characterized in that the housing parts are formed as a cast construction.

11. The liquid ring pump as claimed in claim 2, characterized in that the first housing part has fixing elements to be clamped axially with the second and third housing parts.

12. The liquid ring pump as claimed in claim 3, characterized in that the first housing part has connections for emptying fluid and/or emptying dirt, for cavitation prevention and for venting on the suction side.

13. The liquid ring pump as claimed in claim 3, characterized in that the housing parts are formed as a cast construction.

14. The liquid ring pump as claimed in claim 3, characterized in that the first housing part has fixing elements to be clamped axially with the second and third housing parts.

15. The liquid ring pump as claimed in claim 4, characterized in that the housing parts are formed as a cast construction.

* * * * *